US006416296B1

(12) United States Patent
Nunes, Jr. et al.

(10) Patent No.: US 6,416,296 B1
(45) Date of Patent: Jul. 9, 2002

(54) RECIPROCATING HERMETIC COMPRESSOR

(75) Inventors: Ernani Pautasso Nunes, Jr.; Dietmar Erich Bernhard Lilie; Adilson Manke, all of Joinville (BR)

(73) Assignee: Empresa Brasileira De Compressores S.A., Joinville (BR)

( * ) Notice: Subject to any disclaimer, the term of this patent is extended or adjusted under 35 U.S.C. 154(b) by 0 days.

(21) Appl. No.: 09/530,924

(22) PCT Filed: Dec. 16, 1998

(86) PCT No.: PCT/BR98/00115

§ 371 (c)(1),
(2), (4) Date: Jun. 22, 2000

(87) PCT Pub. No.: WO99/32790

PCT Pub. Date: Jul. 1, 1999

(30) Foreign Application Priority Data

Dec. 22, 1997 (BR) ..... 9706307

(51) Int. Cl.[7] ..... F04B 23/14
(52) U.S. Cl. ..... 417/201; 418/88; 417/410.1
(58) Field of Search ..... 417/201, 410.1; 418/88

(56) References Cited

U.S. PATENT DOCUMENTS 5,007,808 A * 4/1991 Frase, Jr. et al. ..... 417/368
5,176,506 A 1/1993 Siebel

FOREIGN PATENT DOCUMENTS

EP 0 433 212 6/1991 ..... F04C/29/02

OTHER PUBLICATIONS

Patent Abstracts of Japan, vol. 008, No. 012 (M–269), Jan. 19, 1984.
Patent Abstracts of Japan, vol. 012, No. 012 (M–269), Jan. 19, 1984.
Patent Abstracts of Japan, vol. 007, No. 104 (M–212), May 6, 1983.
Patent Abstracts of Japan, vol. 008, No. 154 (M–310), Jul. 18, 1984.
Patent Abstracts of Japan, vol. 007, No. 246 (M–253), Nov. 2, 1983.
Patent Abstracts of Japan, vol. 013, No. 048 (M–793), Feb. 3, 1989.

* cited by examiner

*Primary Examiner*—Charles G. Freay
*Assistant Examiner*—William Rodriguez
(74) *Attorney, Agent, or Firm*—Darby & Darby

(57) ABSTRACT

A reciprocating hermetic compressor, of the type including a rotor with permanent magnets and having its tubular vertical shaft (5) provided radially externally to the internal surface thereof with at least one axial channel (10) of oil conduction, having a lower end (11) immersed in the lubricant oil being pumped from a lubricant oil sump (2) defined at the bottom of the hermetic shell of the compressor, and an upper end (12) opened to a median radial duct (5*a*), which conducts lubricant oil to the parts of the compressor spaced away from the lubricant oil sump (2).

6 Claims, 3 Drawing Sheets

RECIPROCATING HERMETIC COMPRESSOR

FIELD OF THE INVENTION

The present invention refers to a construction for a reciprocating hermetic compressor of the type having a motor with permanent magnets affixed to a vertical shaft and, more particularly, to a construction for this vertical shaft of the reciprocating compressor.

BACKGROUND OF THE INVENTION

Compressors having an electric motor with a rotor carrying permanent magnets are used in refrigeration appliances because they allow the angular speed of the compressor shaft to be varied, either continuously or discretely, within a determined rotation range.

The hermetic refrigeration compressors are constructed according to two possible dispositions of the mechanical elements inside the shell thereof. In one of these constructions, the connecting rod-crankshaft system of the compressor is positioned below the electric motor, close to or immersed in the lubricant oil sump existing at the bottom of the compressor shell. In another of these constructions, the connecting rod-crankshaft system is positioned above the electric motor and therefore spaced, by a considerable height, from the lubricant oil sump provided at the bottom of the compressor shell.

Among other factors, the lubrication efficiency of the mechanical system is affected by the amount of oil reaching the movable parts, resulting from the rotation of the compressor shaft, which actuates an oil pump (or centrifugation tube). The oil pumping resulting from the rotation of the tubular vertical shaft generates an oil transportation ascending curve, in the form of an oil parabola, whose upper end should reach or surpass an oil delivery point in the form of a median radial duct provided in the body of the tubular vertical shaft of the compressor in a median Portion of its longitudinal extension.

Thus, the amount of oil available for lubricating the movable parts depends on the centrifugation speed which, on its turn, is equal to the angular speed of the shaft. If the angular speed of the shaft is lower than a predetermined limit value, the end of the parabola will not reach the delivery point, and therefore there will not be enough pumped oil for lubrication. The amount of pumped oil also depends on the required elevation height, which is the height defined between the oil level in the sump and the outlet of said oil at the delivery point.

In order to guarantee an efficient lubrication of the movable parts during the operation of the compressor in low rotations, some known techniques are used.

One of the techniques to guarantee the volume of oil needed to lubricate the movable parts of the compressor is to use a type of construction which foresees the connecting rod-crankshaft system situated below the electric motor. In this case, there is a considerable reduction in the pumping elevation, which is necessary between the oil level in the sump and the delivery point of the lubricant oil (which, in this case, may be the connecting rod-crankshaft system itself).

Another technique for reducing the height between the oil level and the delivery point of the lubricant oil (elevation height) is to add oil to the sump, as a form of increasing its level and, consequently, reduce the elevation height to be overcome.

The lubrication of the movable parts can also be assured by limiting the minimum rotation in which the shaft is operated, in order to assure that a minimum indispensable amount of oil always reaches the desired height.

Using the type of construction in which the mechanical system is positioned below the compressor shell (motor at the upper part) has the disadvantage that the coils of the electric motor do not have a direct contact with the oil in the sump (immersion) and, therefore, the cooling of said coils is less efficient. The poor cooling of the motor may cause degradation of its insulating and conducting materials. Another disadvantage of this technique is that the mechanical system may cause, by the movement of the shaft, a turbulence of the oil in the sump, which may generate noise during operation.

A deficiency in using the technique of increasing the oil level in the compressor sump is the higher cost of adding more oil. Another disadvantage of increasing the oil level is associated with the possibility of this oil contacting the lower surface of the rotor during the compressor operation, producing whirl and foaming of the lubricant oil. This foaming causes deficiency in the lubrication and increases the power consumption for the compressor operation.

The technique of limiting the minimum rotation in which the shaft operates, in order to guarantee that a minimum indispensable oil amount always reaches a desired height has, as an intrinsic disadvantage, the limitation of the rotation range in which the compressor may operate.

DISCLOSURE OF THE INVENTION

Thus, it is an objective of the present invention to provide a reciprocating hermetic compressor in which, independently from the positioning of its motor assembly inside the shell, occurs an adequate lubrication of the movable parts of the compressor needing lubrication, even in low rotations and with no need for increasing the oil level in the sump defined at the bottom of the compressor shell, or for using additional parts other than those already existing in the pumping system of said compressor.

This and other objectives are attained by a reciprocating hermetic compressor, including a hermetic shell, which defines at its bottom a lubricant oil sump and which lodges a cylinder block supporting a tubular vertical shaft having at least a median radial duct of oil passage and carrying at the bottom thereof an oil pump immersed in the lubricant sump, the oil being pumped upon rotation of the tubular vertical shaft towards the median radial duct, said tubular vertical shaft being provided, axially and externally to its internal periphery, with at least one axial channel of oil conduction, having a lower end immersed in the lubricant oil being pumped and an upper end opened to a respective median radial duct.

BRIEF DESCRIPTION OF THE DRAWINGS

The invention will be described below, with reference to the attached drawings, in which.

BEST MODE OF CARRYING OUT THE INVENTION

Figure 1:
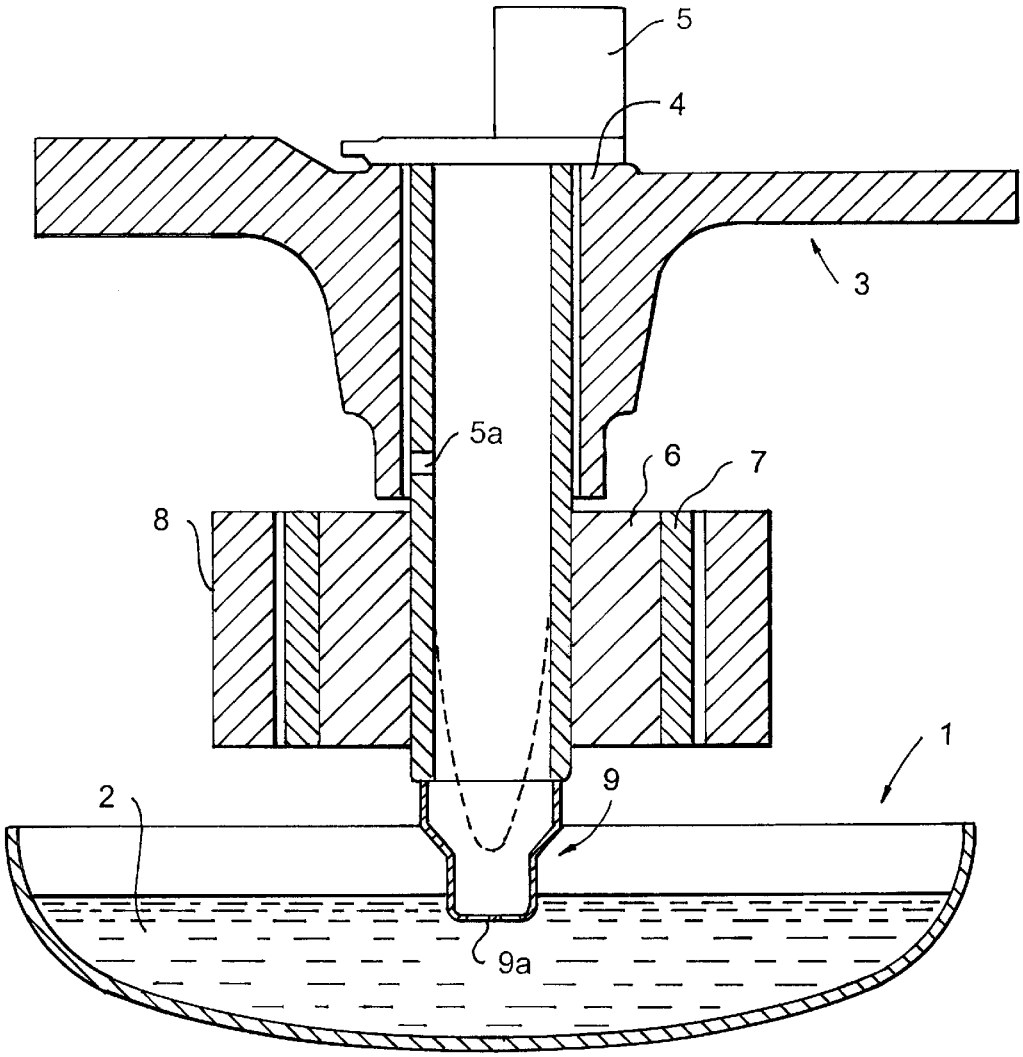
Fig. 1 (Prior Art)
FIG. 1 shows, schematically and in a longitudinal sectional view, part of a reciprocating compressor, with a tubular vertical shaft mounted to a cylinder block and carrying an oil pump, constructed according to the prior art.

According to FIG. 1, a hermetic compressor of vertical shaft comprises a hermetic shell 1 defining a lubricant oil sump 2 at the bottom thereof and lodging therewithin: a cylinder block 3 incorporating a bearing 4, for supporting the tubular vertical shaft 5, to which is mounted, at a portion of said shaft below the bearing 4, an electric motor rotor 6 carrying magnets 7, and further including a stator 8 affixed to the cylinder block 3.

The tubular vertical shaft 5 carries, at the lower portion thereof, an oil pump 9, whose lower end is immersed in the oil mass provided in the lubricant oil sump 2. During rotation of the tubular vertical shaft 5, the oil of the lubricant oil sump 2 is upwardly conducted by centrifugation, through an oil duct defined inside the tubular vertical shaft 5, to a median radial duct 5*a* provided in the body of the tubular vertical shaft 5 at the region of the bearing 4 through the lateral wall of said tubular vertical shaft 5. The lubricant oil, which is pumped by the oil pump 9 upon rotation of the rotor 6 and tubular vertical shaft 5 and which reaches the median radial duct 5*a* is distributed to the movable parts of the compressor spaced away from the lubricant oil sump 2 of said compressor.

In these compressors, the pumping efficiency is a function of the relationship between a smaller diameter of the lower end of the oil pump 9 immersed in the lubricant oil sump 2, and a larger diameter defined by the internal diameter of the tubular vertical shaft 5. The closer these values, lesser will be the lubrication efficiency of the oil pump, as already discussed in the beginning of this disclosure. According to the present invention, the improvement of the pumping capacity is obtained by increasing the difference between the smallest radius of oil admission defined at the lower end of the oil pump 9, and a larger radius of maximum value in relation to the oil pump axis. This larger radius is achieved by machining at least one axial channel 10 of oil conduction, disposed radially externally to an internal lateral surface of the tubular vertical shaft 5 and having at least part of the longitudinal extension thereof substantially rectilinear and extending along a determined longitudinal extension of said tubular vertical shaft 5, and communicating a lower nozzle 9*a*, of oil admission to the oil pump 9, with the median radial duct 5*a*.

With this radius increase, the oil pumping to the height where is found the median radial duct 5*a* may occur with a lower rotation of the motor. This allows the compressor to operate with lower rotations than those conventionally required to the same oil pumping to said median radial duct 5*a*.

The oil pumping resulting from the rotation of the tubular vertical shaft 5 determines a curve of oil distribution in the form of a paraboloid generated by centrifugation and whose height is proportional to the square of the smallest radius of centrifugation found in the path from the oil level in the sump up to the median radial duct 5*a*.

According to the present invention, each axial channel 10 has at least a substantial part of its longitudinal extension disposed between a lower end 11 immersed in the oil being pumped by the oil pump 9 when under operation, and an upper end 12 opened to a respective median radial duct 5*a*.

The lower end 11 is provided in the tubular vertical shaft 5 opened to the inside of the oil pump 9, particularly to the lower end of the tubular vertical shaft 5, which is found immersed in the lubricant oil during rotation of the tubular vertical shaft 5.

Figure 2:
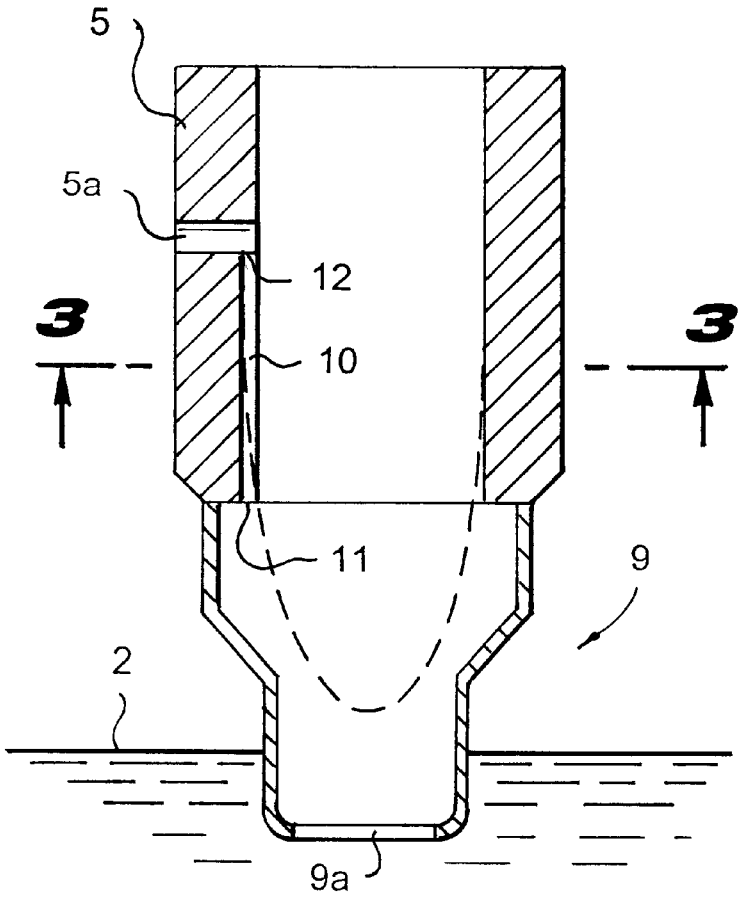
FIG. 2 shows, schematically and in a longitudinal sectional view, part of the tubular vertical shaft of the compressor constructed according to the present invention.
Figure 3:
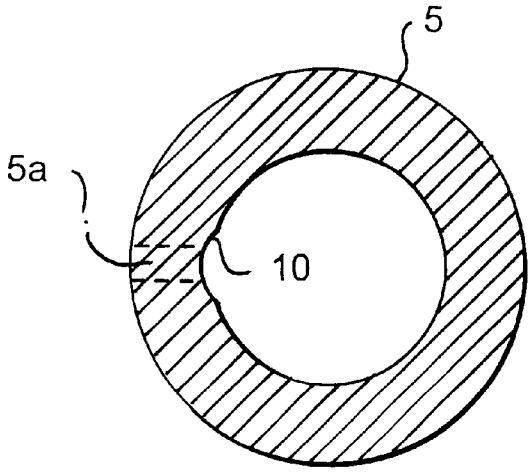
FIG. 3 shows, schematically and in a cross-sectional view, the tubular vertical shaft of the compressor constructed according to the present invention.
Figure 4:
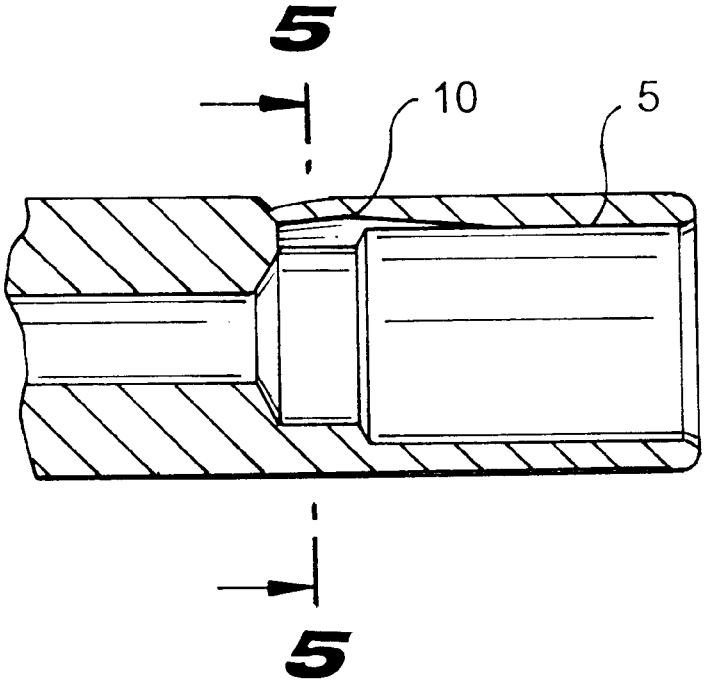
FIG. 4 is a cross-sectional view of a part of the shaft showing the channel.
Figure 5:
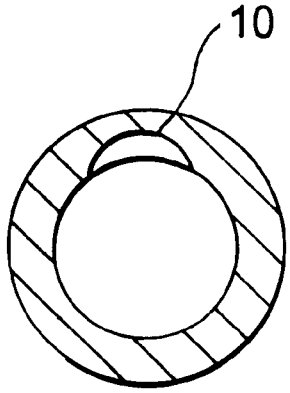
FIG. 5 is a cross-section along line 5—5 of FIG. 4.

In the preferred illustrated solution (FIGS. 2 and 3), the tubular vertical shaft 5 is provided with a single axial channel 10, for example upwardly diverging from the axis of the tubular vertical shaft 5 from the lower end 11 thereof and which is produced in the form of a half-tubular cross-section from the internal lateral surface of the tubular vertical shaft 5. Depending on the inclination, the groove which defines the axial channel 10 has a variable increasing depth from the lower end 11 of said axial channel 10. With the provision of an axial channel 10 which produces, at the region of the tubular vertical shaft 5, an increase in the inner radius thereof, the oil distribution curve has a height which is sufficient to reach the median radial duct 5*a*, even in low rotations.

The radius increase may also be obtained from axial slots produced radially externally to the internal lateral surface of the tubular vertical shaft 5, in the wall thickness and along the longitudinal extension thereof, parallel to its axis or also diverging therefrom and with a cross-section different from the one described herein, without altering the efficiency of oil conduction.

The present solution has the advantages of increasing the inner radius of centrifugation and, consequently, the lubrication efficiency, even in low rotations of the motor, without requiring additional parts or constructive modifications of the oil pump.

What is claimed is:

1. A reciprocating hermetic compressor comprising:

a hermetic shell which defines at its bottom a sump for oil lubricant;

a cylinder block within said hermetic shell supporting a tubular vertical shaft that is rotated, said tubular shaft having at least one axial channel on its internal surface extending upwardly from the tubular shaft lower end and a radial duct through the shaft above the tubular shaft lower end that communicates with said at least one axial channel;

the lower end of said tubular shaft being immersed in the oil in said sump to be pumped upwardly along a said at least one axial channel and out through said radial duct to other parts of the compressor as said shaft is rotated.

2. A reciprocating hermetic compressor, as in claim 1 wherein a said at least one axial channel has at least a substantial part of its longitudinal extension inclined and upwardly diverging from the axis of the tubular vertical shaft.

3. A reciprocating hermetic compressor, as in claim 2, wherein each axial channel is in the form of a longitudinal groove provided in the internal lateral surface of the tubular vertical shaft.

4. A reciprocating hermetic compressor, as in claim 3, wherein each axial channel has a half-tubular cross-section.

5. A reciprocating hermetic compressor, as in claim 4, wherein each axial channel has a variable cross-section along the longitudinal extension thereof.

6. A reciprocating hermetic compressor as in claim 1 further comprising a pump at the lower end of the shaft to pump oil from the sump.

* * * * *